United States Patent [19]

Hansen

[11] 4,230,756

[45] Oct. 28, 1980

[54] RIBBED TICK WITH INSULATING FILLER

[75] Inventor: Sigurd S. Hansen, Fruens Boge, Denmark

[73] Assignee: Nordish Fjerfabrik Aktieselskab, Copenhagen, Denmark

[21] Appl. No.: 1,747

[22] Filed: Jan. 8, 1979

Related U.S. Application Data

[63] Continuation of Ser. No. 513,464, Oct. 9, 1974, Pat. No. 4,137,111.

[30] Foreign Application Priority Data

Oct. 29, 1973 [DK] Denmark ..... 5479/73
Jul. 5, 1974 [DK] Denmark ..... 3620/74

[51] Int. Cl.[3] ..... B32B 1/06; B32B 3/28; B32B 7/10; B32B 7/14

[52] U.S. Cl. ..... 428/101; 5/441; 5/442; 5/455; 5/456; 5/457; 5/480; 156/331; 428/182; 428/188; 428/196; 428/198

[58] Field of Search ..... 5/441, 442, 455, 456, 5/457, 480; 428/101, 182, 188, 196, 198

[56] References Cited

U.S. PATENT DOCUMENTS

| | | | |
|---|---|---|---|
| 254,265 | 2/1882 | Bonl | 5/457 |
| 1,394,061 | 10/1921 | Bernstein | 5/480 |
| 2,046,039 | 6/1936 | Schaar | 5/458 |
| 2,465,268 | 3/1949 | Rogers et al. | 5/441 |
| 2,515,806 | 7/1950 | Spanel | 5/457 |
| 2,887,692 | 5/1959 | Gosman | 5/458 |
| 3,056,980 | 10/1962 | Holladay | 5/455 |
| 3,983,587 | 10/1976 | Gorran | 5/441 |
| 4,137,111 | 1/1979 | Hansen | 156/65 |

FOREIGN PATENT DOCUMENTS

| | | | |
|---|---|---|---|
| 13543 | 8/1916 | United Kingdom | 5/457 |
| 444280 | 3/1936 | United Kingdom | 5/457 |

*Primary Examiner*—James C. Cannon
*Attorney, Agent, or Firm*—Watson, Cole, Grindle & Watson

[57] ABSTRACT

A ribbed tick comprising a top sheet and a bottom sheet connected at their edges and at least one ribbon-shaped partition wall connected to the inner sides of the top and bottom sheets by welded seams extending along the longitudinal edges of the partition wall.

A method of preparing a ribbed tick comprising the steps of placing a ribbon having tapes of a thermoplastic film material located at its longitudinal edges between a top sheet and a bottom sheet material, heating the tapes to melt the thermoplastic film material and to bond the ribbon to the top and bottom sheet materials and connecting the top and bottom sheet materials to form a ribbed tick having ducts for a stuffing material.

3 Claims, 5 Drawing Figures

Fig. 1
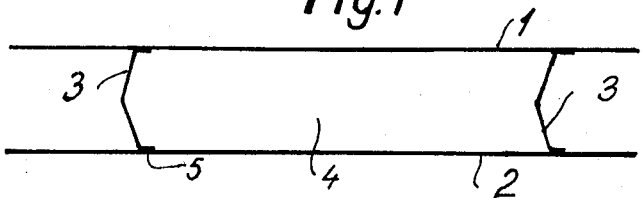
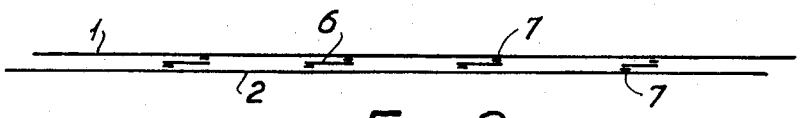
Fig. 2
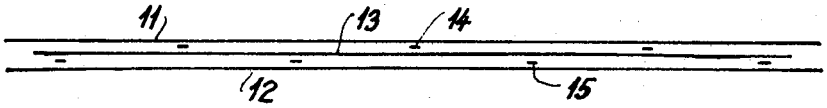
Fig. 3

RIBBED TICK WITH INSULATING FILLER

This is a continuation of application Ser. No. 513,464 filed Oct. 9, 1974 and now U.S. Pat. No. 4,137,111.

BACKGROUND OF THE INVENTION

This invention relates to a ribbed tick and more particularly a ribbed tick for an eiderdown, a featherbed or a pillow, the ribbed tick comprising a top sheet and a bottom sheet which are connected at their edges and at least one ribbon-shaped partition wall which at its longitudinal edges is connected to the top sheet and bottom sheet, respectively, so as to form ducts extending from one end of the tick to the other.

In prior art ribbed ticks of this type, the ribbon-shaped partition walls are made from a woven textile material and are sewn to inwardly extending folds of the top sheet and bottom sheet, respectively.

A serious drawback of such prior art ticks is that their production is both difficult and labour consuming. Furthermore, when using patterned top and bottom sheets, the patterns tend to be broken, when the above-mentioned folds for the attachment of the ribbons are formed.

In order to solve this problem it has been attempted to cut the textile materials from which the top and bottom sheets are made into strips so that these can be sewn together to form the folds while obtaining an unbroken pattern. These precautions, however, have further increased the production costs and time, and have caused waste of the textile materials.

The object of the invention is to provide a ribbed tick of the above-mentioned type, the production of the tick being simple and quick. Another object of the invention is to provide a ribbed tick which can be made from patterned top and bottom sheets without breaking the patterns and without requiring extra precautions and waste of material.

SUMMARY OF THE INVENTION

These objects are achieved by the ribbed tick of the invention in which the longitudinal edges of the ribbon-shaped partition walls are connected to the inner surfaces of the top and bottom sheets by welded seams.

By using a welded seam to connect the longitudinal edges of the ribbon-shaped partition wall to the top and bottom sheets, respectively, instead of folding the sheets and sewing the folds and the partition wall together, the production of ticks can be greatly simplified and the production time can be considerably reduced. Thus, the time for producing a typical ribbed tick for an eiderdown having 7 ducts can be reduced from about 17 minutes to 0.5 minutes.

Furthermore, by attaching the partition walls to the inner sides only of the top and bottom sheets, the patterns which may be provided thereon are not broken. Finally, whether the top and/or bottom sheets are provided with a pattern or not, no material is wasted, because the folds of the prior art ticks are avoided.

The ribbed tick of the invention also eliminates another problem which has caused considerable difficulties. In recent years, synthetic fibres have gained increased utility as a stuffing material in pillows in order to make such pillows washable. However, when such pillows are centrifuged during a washing operation, synthetic fibres tend to form hard lumps, whereby the original bulkiness of such pillows is lost. In an attempt to eliminate the formation of lumps, it has been attempted to use ribbed ticks prepared by the above-mentioned prior art method. Such pillows, however, are uncomfortable, because the seams with which the partition walls are sewn to the folds of the top and bottom sheets form hard zones.

By using the ribbed ticks of the invention, these problems are solved, because the welded seams are flexible and do not make such pillows uncomfortable. Consequently, it has been made possible to avoid or reduce the lump formation during the washing operation. In a preferred embodiment of the ribbed tick of the invention, the welded seam has been provided by heating and subsequently cooling a thermoplastic resin applied to a ribbon at its longitudinal edges before contacting the ribbon with the inner sides of the top sheet and the bottom sheet.

A welded seam produced in this manner forms a strong bond to a textile material.

In order to counteract a quick conduction of heat from one side of a stuffed ribbed tick to the opposite side, the welded seam with which a ribbon is connected to the top sheet is laterally offset relative to the welded seam, with which the ribbon is connected to the bottom sheet. Thus, in a stuffed tick, the ribbons forming partition walls between the ducts form angles which are different from 90° relative to both the top sheet and the bottom sheet, and consequently the rate at which heat is transferred from one side of the tick to the other is reduced. Furthermore, the stuffed tick becomes more flexible and consequently more comfortable to use.

The invention also relates to a method of preparing the above-mentioned ribbed ticks. This method comprises the steps of introducing between two textile materials a further textile material having spaced zones of a thermoplastic material, heating the thermoplastic material to a temperature sufficiently high to melt the material and to form welded seams bonding the textile materials together, cooling the welded seams and connecting the edges of the outermost textile materials.

Although the invention in the following may be described with reference to one partition wall only, it should be understood that in most cases several partition walls are used to form a corresponding number of ducts in the tick.

In a preferred embodiment of the invention the further textile material is a textile ribbon having strips of a thermoplastic material attached thereto at its longitudinal edges. In one embodiment of the invention two strips are attached to the ribbon at one side thereof, and the ribbon is folded along lines extending longitudinally of said ribbon so that the strips are located at the exterior side of the folded ribbon.

By using such a folded ribbon, the heating should be effected only within a relatively narrow zone in order to provide the two welded seams.

In another preferred embodiment of the invention, the ribbons are provided with strips of a thermoplastic material at their opposite sides, and the ribbons are introduced between the top sheet and bottom sheet in a flat condition. In that case, welded seams which are laterally offset, are obtained.

The above-mentioned method is preferably carried out continuously by bringing two webs of a textile material together, introducing between the two webs at least one textile ribbon having at its longitudinal edges strips of a thermoplastic material, passing the combined webs through at least one heating station having means for heating the thermoplastic material to a sufficiently high temperature to melt it, and to form welded seams, cooling the welded seams formed, cutting the joined webs at spaced locations and joining the edges of the joined sheets thus formed. In order to make the welded seams as strong as possible, the combined webs are preferably heated and cooled several times, and heat is preferably supplied to the combined webs from alternating sides of the combined webs.

In another preferred embodiment of the invention the ribbons provided with strips of thermoplastic material are heated before they are introduced between the two webs. Such preheating further increases the strength of the welded seam.

A folded ribbon provided with strips of thermoplastic material may be prepared continuously by initially passing the ribbon through a folding device in which the ribbon is folded along its longitudinal and subsequently to a heating zone in which the ribbon is heated to fix the folded configuration. The ribbon may then be rolled up in folded or flat condition, so as to be stored before the strips of thermoplastic material are applied thereto.

The application of the strips of thermoplastic material, e.g., film strips, may be effected in an impulse welding machine by simultaneously introducing therein two film strips made from a thermoplastic material and the ribbon to which the strips are to be attached. During the passage through the impulse welding machine, the film strips are attached to the ribbon in spots or within limited areas. After the attachment of the film strips to the ribbon at its longitudinal edges, the ribbon may be preheated before it is placed between the top and bottom sheets or the webs, from which the sheets are formed. Examples of thermoplastic materials from which the film strips can be made, are polyethylene, polypropylene, polyamide-6, polyamide-6,6, and polyacetate.

The top and bottom sheets and/or the webs from which such sheets are made, are preferably woven textile materials made from natural fibres or mixtures of natural and synthetic fibres. By using textile materials containing thermoplastic synthetic fibres, the strength of the welded seams may be further increased. Examples of such thermoplastic synthetic fibres are cellulose acetate, polyamide and polyolefin fibres.

BRIEF DESCRIPTION OF THE DRAWINGS

FIG. 1 schematically illustrates a cross-sectional view of a preferred embodiment of the ribbed tick of the invention;

FIG. 2 is a schematical cross-sectional view of the location of ribbons and film strips relative to a top and a bottom sheet in a preferred embodiment of the method of the invention;

FIG. 3 is a schematical cross-sectional view which illustrates the manner in which the partition walls are attached to the top and bottom sheet in another preferred embodiment of the method of the invention.

DESCRIPTION OF THE PREFERRED EMBODIMENTS

Figure 4:
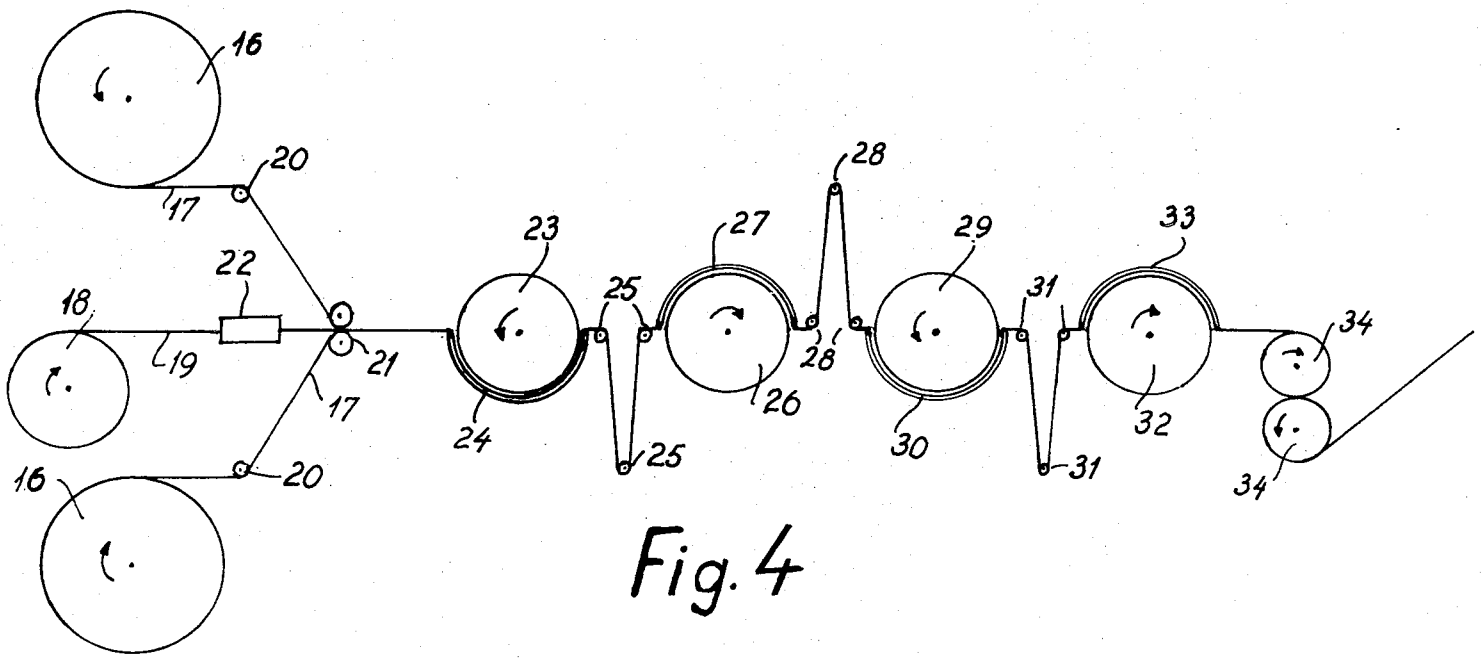
FIGS. 4–5 schematically illustrates two different apparatuses for carrying out the method of the invention.

FIG. 1 shows a top sheet 1 made from a woven textile material 1 and a similar bottom sheet 2. The top and bottom sheets are connected by woven ribbons 3 so as to form a duct 4 for a stuffing material. The ribbons 3 are connected to the inner sides of the top sheet 1 and the bottom sheet 2 by means of welded seams 5.

In FIG. 2, ribbons 6 are placed in flat condition between a top sheet 1 and a bottom sheet 2. Strips 7 of a film of thermoplastic material are located along the longitudinal edges of the ribbons 6, the strips being placed at the right side of the ribbon at its upper side and along the left side at its lower side.

FIG. 3 shows a top sheet 11 and a bottom sheet 12 which are separated by a sheet 13 which is to form partition walls in the final ribbed tick. At spaced zones strips 14 of a thermoplastic material are placed between the top sheet 11 and the sheet 13. In a similar manner, but offset relative to the strips 14, strips 15 of a thermoplastic material are placed between the bottom sheet 12 and the sheet 13.

The components which are shown in FIG. 1 may be combined so as to form a ribbed tick by means of the apparatus illustrated in FIG. 4. This apparatus comprises two rolls 16 each made up of webs 17 from which top sheets and bottom sheets are to be made. 18 is a roll of a ribbon 19 having longitudinally extending film strips of a thermoplastic material applied thereto, the film strips being located at the longitudinal edges of the ribbon.

The webs 17 are passed around guide rollers 20 and into a nip zone of a pair of rollers 21. The ribbon 19 is passed through a preheating apparatus 22 and then into the nip zone between the pair of rollers 21, in which it is introduced between the two webs 17. The combined webs 17 and the intermediate ribbon 19 are then introduced into the space between a heated roller 23 and an insulation shield 24. After having passed through the space, the combined webs are passed around rollers 25, and during the passage around the rollers the combined webs are cooled in order to avoid the webs being burned when subsequently subjected to a further heat treatment.

The combined webs are then introduced into a zone between a heated roller 26 and an insulation shield 27. The webs are then cooled again by passing around rollers 28. A further heating followed by a cooling and a final heating are then effected by passing the combined webs into a zone between a heated roller 29 and an insulation shield 30, around rollers 31 and into a zone between a heated roller 32 and an insulating shield 33.

Finally the combined webs are contacted with a set of cooling rollers 34. The combined webs are then cut transversely into pieces of predetermined lengths and the edges of the pieces are connected by sewing.

It should be noted that although only one roll 18 of a ribbon 19 has been shown, a number of such rolls are used in practice, so as to form a plurality of ducts in the final ribbed tick.

Figure 5:
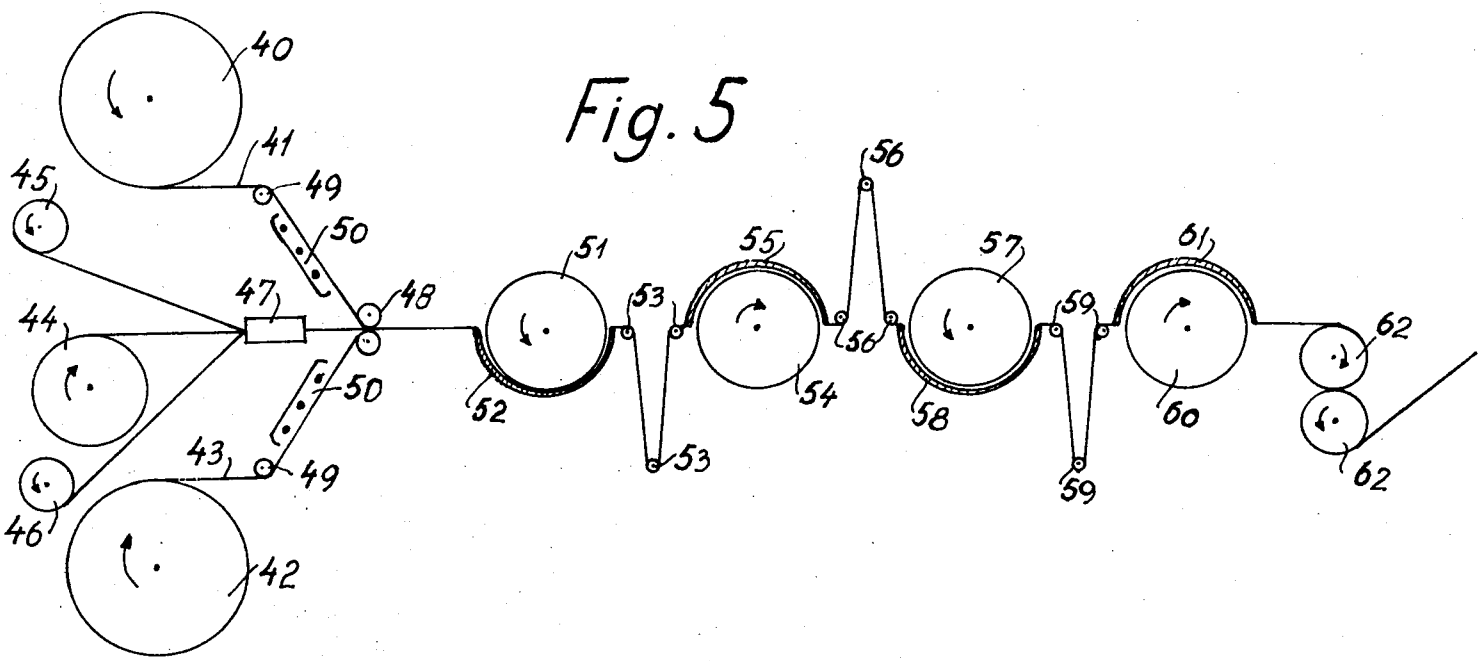

FIG. 5 shows an apparatus comprising a roll 40 of a web 41 of a textile material and a roll 42 of another web 43 also made from a textile material. Numeral 44 represents either a number of rolls of ribbons (such as 6 in of FIG. 2), or a roller of a web (such as 13 in FIG. 3).

Numerals 45 and 46 represent rolls of film strips of a thermoplastic material (i.e., corresponding to 6 in FIG. 2 or 14 or 15 in FIG. 3). The strips are contacted with the ribbons or the web from the roll 44 in a feed apparatus 47 from which they are passed through the nip zone of a pair of rollers 48. The webs 41 and 43 are also passed into the nip zone after having passed rollers 49 and heating devices 50. The two webs 41 and 43 and the intervening ribbons or webs and film strips are then passed through four heating stations comprising felt coated insulated rollers 51, 54, 57 and 60, and curved heating devices 52, 55, 58 and 61, comprising heating means located in zones corresponding to those of the film strips. During the passage through the stations, the material is heated from alternating sides. When passing from one heating station to the other, the material is passed around sets of rollers 53, 56 and 59 to cool the material. Subsequently, the material is contacted with a pair of cooling rollers 62.

During the heat treatments the material is heated within the zones in which the strips of thermoplastic material are located so as to melt the material and to bond the ribbons or the web located between the webs 41 and 43 to the latter.

Finally, the material is cut transversely to form pieces, the edges of which are joined by sewing.

EXAMPLE

A textile ribbon having a weight of 100 g/m$^2$ and consisting of linen-woven cotton (24/28) prepared from yarns having a yarn number Nm of 50 was used as partition wall material. Polyethylene strips having a width of 6 mm and consisting of four layers of polyethylene films, each having a thickness of 80$\mu$ and consisting of polyethylene of a melt index of 2, were applied to the ribbon at its longitudinal edges.

The polyethylene strips were attached to the ribbon by impulse welding.

The ribbon thus formed was introduced between two webs of linen-woven (45, 42) cotton, the webs having a weight of 130 g/m$^2$ being made from yarns having a yarn number Nm of 70. Prior to the introduction of the ribbon it was pretreated to a temperature of about 120° C.

The combined webs were then contacted with a number of heated rollers in an apparatus as illustrated in FIG. 4.

The temperature of the rollers was 190° C., and the contact time was about 5 seconds.

During the passage of the combined webs from one heated roller to the following, the material was cooled.

Subsequently, the material was contacted with rollers having room temperature. Finally the material was cut into predetermined lengths and the pieces thus formed were sewn at their edges. The welded seams with which the ribbon were connected to the top and the bottom sheets in the final product were strong and flexible.

I claim:

1. A ribbed tick adapted to be filled with a flexible insulating filler to form a pillow, quilt, feather bed or eiderdown comprising a top and a bottom sheet of textile material, the top and bottom sheets being connected at their edges, and a single intermediate sheet interposed between the top and the bottom sheet, the intermediate sheet being alternatingly connected to the inner surfaces of both the top and bottom sheets by a plurality of seams formed from layers of thermoplastic material, the seams between the intermediate sheet and the top sheet being parallel to and offset from the seams between the intermediate sheet and the bottom sheet so as to form a plurality of channels for containing said flexible insulating filler.

2. A ribbed tick as in claim 1, wherein the intermediate sheet is of a textile material.

3. A ribbed tick as in claim 1, wherein each seam comprises a strip of a thermoplastic material.

* * * * *

UNITED STATES PATENT OFFICE

CERTIFICATE OF CORRECTION

PATENT NO. : 4,230,756

DATED : October 28, 1980

INVENTOR(S) : Sigurd Skovlund Hansen

It is certified that error appears in the above-identified patent and that said Letters Patent are hereby corrected as shown below:

ON THE TITLE PAGE, ITEM [30] should read

-- [30] FOREIGN APPLICATION PRIORITY DATA

October 9, 1973 [DK] Denmark.....5479/73
July 5, 1974 [DK] Denmark.....3620/74 --.

Signed and Sealed this

First Day of March 1983

[SEAL]

Attest:

GERALD J. MOSSINGHOFF

Attesting Officer

Commissioner of Patents and Trademarks